United States Patent [19]

Rudy, Jr. et al.

[11] Patent Number: 4,735,583

[45] Date of Patent: Apr. 5, 1988

[54] SPRING LATCH FOR LATCHING TOGETHER ELECTRICAL CONNECTORS AND IMPROVED LATCHING SYSTEM

[75] Inventors: William J. Rudy, Jr., Annville; Howard R. Shaffer, Millersburg; Daniel E. Stahl, Dauphin, all of Pa.

[73] Assignee: AMP Incorporated, Harrisburg, Pa.

[21] Appl. No.: 42,201

[22] Filed: Apr. 24, 1987

[51] Int. Cl.[4] ..... H01R 13/631

[52] U.S. Cl. ..... 439/350; 439/355; 439/731

[58] Field of Search ..... 439/345, 347, 350, 355, 439/357–358, 731

[56] References Cited

U.S. PATENT DOCUMENTS

| | | | |
|---|---|---|---|
| 2,760,174 | 8/1956 | Burtt et al. | 439/358 |
| 3,544,951 | 12/1970 | Roberts | 439/358 |
| 3,750,092 | 7/1973 | Bury | 439/357 |
| 3,920,309 | 11/1975 | Garver | 339/198 G |
| 4,032,209 | 6/1977 | Rutkowski | 439/355 |
| 4,319,733 | 3/1982 | Hanna et al. | 248/507 |
| 4,367,003 | 1/1983 | Frantz | 339/91 R |
| 4,619,493 | 10/1986 | Kikuta | 339/91 R |
| 4,621,885 | 11/1986 | Szczesny et al. | 339/91 R |
| 4,641,902 | 2/1987 | Fusselman | 439/350 |
| 4,678,256 | 7/1987 | Nishino et al. | 439/347 |

OTHER PUBLICATIONS

AMP Catalog No. 4507-1, "Engineering and Purchasing Guide—Fifth Edition", p. B-310, AMP Incorporated, Harrisburg, PA, (1984).

*Primary Examiner*—John McQuade
*Attorney, Agent, or Firm*—Anton P. Ness

[57] ABSTRACT

Plug connector modules (22) are ganged together side-by-side by a pair of integral spring latch members (70) secured along commoned end surfaces (42) of the modules (22) to comprise a plug connector assembly (20) manipulatable as a unit. Integral spring latch members (70) include discrete securing sections (76) securable to axial key members (50) within modules (22) near end surfaces (42). Forward ends (84) of spring latch members (70) include latching recesses (100) to latch to latching projections (152) of a receptacle connector (150), latching plug assembly (20) to receptacle connector (150) in mated engagement. Gripping sections (110) of spring latch members (70) are deflectable toward each other about fulcrum sections (112) which action deflects free ends (84) outwardly and disengages latching recesses (100) from latching projections (152) to delatch assembly (20) from receptacle connector (150) for unmating thereof. Spring latch members (70) may be removable from plug connector modules (22) for repair. Latching projections (152) and latching recesses (100) are especially adapted to continuously engage each other to resist effects of vibration, and to resist inadvertent delatching.

19 Claims, 7 Drawing Sheets

SPRING LATCH FOR LATCHING TOGETHER ELECTRICAL CONNECTORS AND IMPROVED LATCHING SYSTEM

FIELD OF THE INVENTION

The invention relates to the field of electrical connectors and more particularly to latching connectors together.

BACKGROUND OF THE INVENTION

Electrical connectors are known which latch together when mated in an axial mating action, securing the electrical contacts therein in an electrically mated or connected condition. Systems for latching commonly provide for delatchability to unmate the connectors. Generally such latching systems are comprised of latch arms integrally molded on one or both connector housings, and a latch arm of one connector contains either a generally simple latching surface at its free end cooperable with a generally simple latching surface of the other connector, or a latching recess at its free end cooperable with a latching projection of the other connector to latch.

U.S. Pat. No. 4,621,885 and application Ser. No. 878,766, now U.S. Pat. No. 4,693,533 assigned to the Assignee hereof disclose a pair of metal latch members affixed to opposite ends of a multi-row first connector. Free ends of the latch members extend forwardly, and during mating to a second connector pass through slots in flanges which action deflects the free ends. When hooks on the free ends completely pass through the slots upon full mating, the hooks latch onto the flanges. The latch members have other free ends which similarly extend through slots of the first connector and have latching recesses which are latched by projections from the sides of the first connector. The latch members also secure a cover to the rearward end of the first connector.

A pair of metal latch members are sold by AMP Incorporated, Harrisburg, Pa. under Part No. 745255-2 (and a similar one-piece member having a spaced pair of similar latch members is sold under Part No. 745011-1). The pair of latch members are secured to a connector by conventional fasteners extending through holes of flanges of metal shield members forwardly and rearwardly of inwardly directed flanges of the latch members and then tightened together trapping a hook portion of the latch flange inside the metal shield members. The latch members then latch the assembly to a mating shielded receptable connector by inwardly directed hooks at forward free ends latching behind ledges on a latching block of the receptable connector assembly. The pair of spring latch members have inwardly deflectable rearward free ends which rotate the members about fulcrum points to deflect the forward free ends outwardly for delatching from the ledges.

U.S. Pat. No. 4,319,733 discloses a pair of locking spring clips each securable to a mating face of a header by a fastener and extending forwardly therefrom to a laterally outwardly deflectable free end containing an inwardly extending latching lug which latches behind a rearward end of a plug connector moved against the header mating face, and the clips are adapted to facilitate delatching by outward deflection of the latching free end.

U.S. Pat. No. 3,920,309 discloses a plug connector assembly including a number of side-by-side housings each with a row of terminal receiving apertures therethrough. The housings have at each end a pair of holes which are aligned with holes of adjacent housings when placed side-by-side, so that pairs of fastener screws are insertable through the aligned holes of all the housings to secure the assembly together when nuts are placed on the screw ends.

It is desirable to provide modular plug connectors which are stackable in side-by-side relationship and to secure the stacked plug connectors together to be manipulated as a unit.

It is desirable to provide a means for latchably and delatchably securing an assembly of stacked plug connectors to a mating receptacle connector.

It is further desirable to provide a stacked connector assembly latchable to and delatchable from a mating connector using a minimum of hardware or accessories.

SUMMARY OF THE INVENTION

According to the present invention, a pair of spring latch members are securable to end surfaces of a plurality of separate side-by-side single row connector housing modules to gang them together to be manipulated as a single multiple-row unit. Each of the spring latch members has adjacent segments corresponding to and extending along end surfaces of the individual modules. Each segment has a forward or first free end to extend toward the mating connector for latching thereto, and an outer body section extending rearwardly from the first free end to a bight section. An inner body section extends forwardly from the bight towards the first free end along the inside surface of the outer body section to a fulcrum section approximately in the middle of the segment. Inwardly from the fulcrum section of the inner body section to extend toward the end surface of a respective module is a transverse securing section for securing the respective module to the spring latch member.

According to one aspect of the invention, the securing section of each segment of each spring latch member comprises a pair of fingers defining a recess therebetween, which recess is disposed to receive therethrough an axially extending projection of the module. The fingers preferably define a constriction at the open end of the recess and are outwardly deflectable so that when the spring latch member is moved transversely against the module end surface the securing section is securable to the projection by being deflectable apart by the projection and resiling when the projection is received into the recess.

According to another aspect of the invention, the first free ends include outwardly angled end sections which are adapted to ride over latching projections along end surfaces of the mating connector, deflecting the free ends outwardly. The latching projections are received into latching recesses in the first free ends when the ganged module assembly is in mated relationship with the mating connector, thus latching them together, when the first free ends resile.

According to yet another aspect of the invention, rearward ends of the segments comprise gripping sections which extend rearwardly of the modules and are inwardly deflectable relative to the modules, with inward deflection of the gripping section of one segment moving those of all segments. The deflection occurs about the fulcrum section, thus urging the first free ends outwardly, disengaging the latching recesses from the latching projections, and enabling removal of the ganged module assembly from the mating connector.

According to still another aspect of the present invention, the latching recess is defined between smooth surfaces of short forward and rearward tab sections pressed outwardly from the plane of the metal of the free ends, with the forward tab section angled to face slightly outwardly to engage a latching surface of the latching projection facing inwardly to prevent inadvertent delatching. The latching projection includes another surface portion facing slightly outwardly toward said latching surface and joining the housing side surface, and the latching projection includes a convex forwardly facing surface. Adjacent the side surface the convex surface and the inner surface portion define a continuous range of axial dimensions including the axial dimension of the latching recess so that the latching projection is in continuous engagement with the short tab sections to resist vibration and minimize its degrading effects, since the latch member's free end retains spring force against the side surface after latching.

It is an object of the present invention to provide a pair of integral members securable to individual side-by-side connector modules at end surfaces to gang them together.

It is another object of the present invention to provide a pair of latching members to gang connector modules together and also provide a means to enable latching to and delatching from a mating connector as a unit.

It is yet another object of the present invention to provide segmented but integral spring latch members where each segment secures to a module and also includes a latching means for latching to the mating connector, and further also includes a gripping section to enable delatching therefrom.

DETAILED DESCRIPTION OF THE PREFERRED EMBODIMENT

Figure 1:
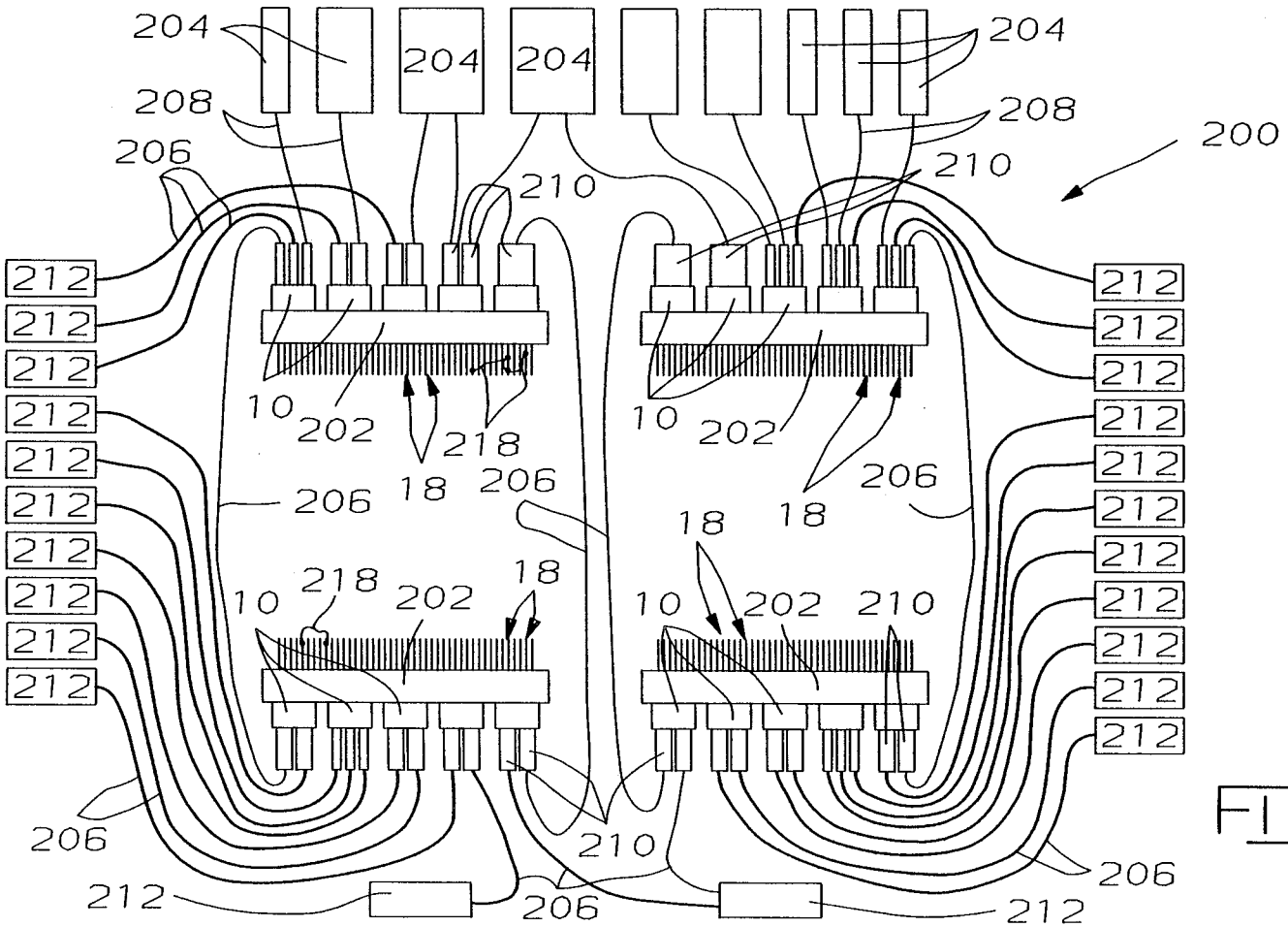
FIGS. 1 and 2 are schematic and perspective views of a wire integration system with which the present invention may be used.
Figure 2:
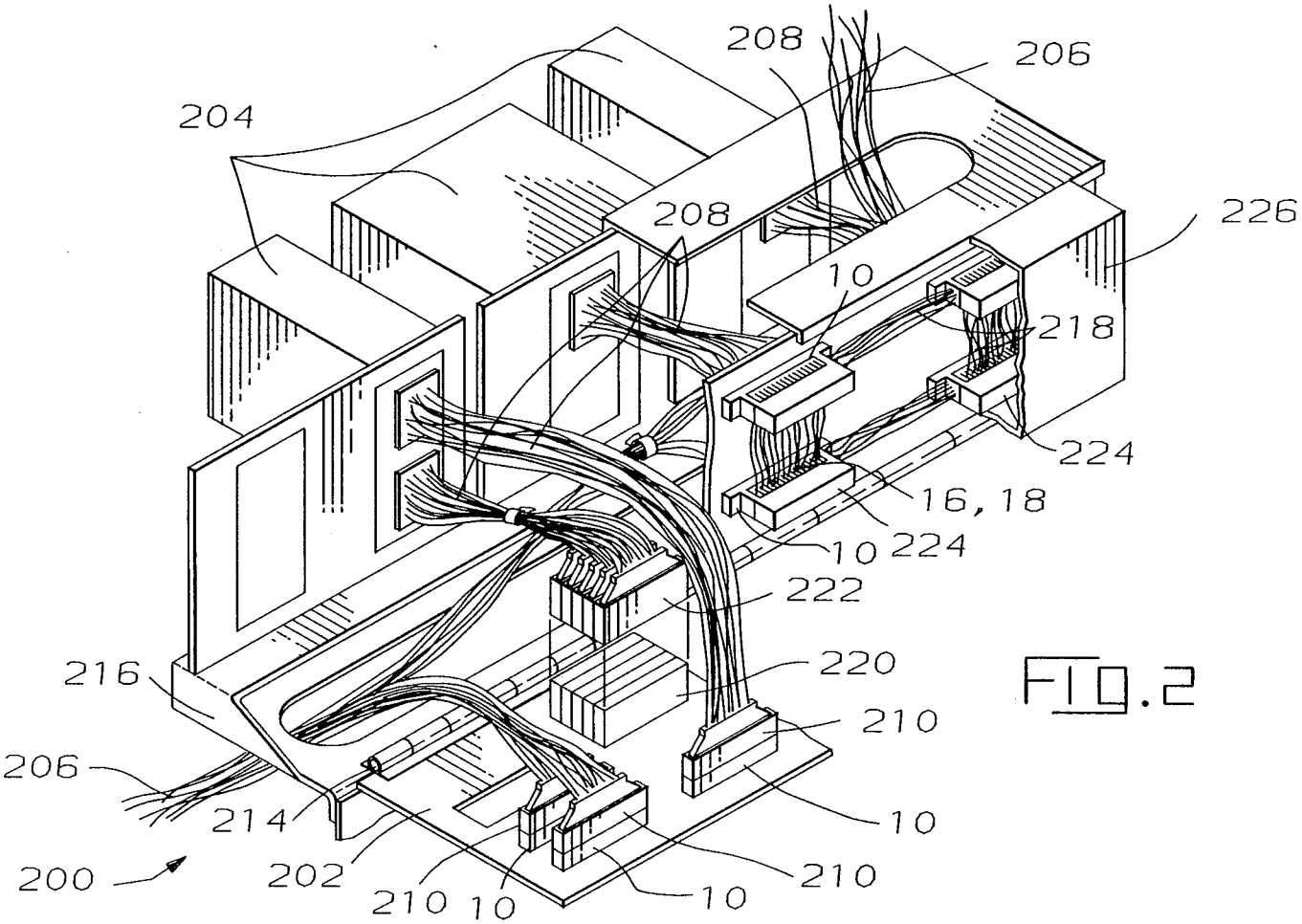

FIGS. 1 and 2 illustrate a wire integration system 200 such as for use on aircraft where a plurality of shipboard systems including power, control, detection, indication, radio reception and transmission and so on must be interconnected or "integrated" at one or more wire integration panels 202 with other such systems. Such systems must be capable of being controlled or sensed at a central location or electrical/electronics bay by a plurality of "black boxes" 204 and also be capable of being interconnected with each other as desired. The black boxes must be capable of removal from the aircraft such as for frequent routine testing and maintenance, or for replacement. Cables 206,208 generally are arranged in bundles or harnesses terminated at one end by modular plug connectors 210 which extend to a wire integration panel 202 on which are mounted receptacle connectors 10 matable at one face of the panel with plug connectors 210. Mating receptacle connectors 10 and Plug connectors 210 are shown having two rows of terminals; a receptacle connector 220 and a plug connector 222 are shown ready to be mated and having five rows of terminals, for example, illustrating the modular capability of wire integration system 200.

Along the face of the panel opposed from the face receiving plug connectors 210, in the embodiment shown, terminals 16 of receptacle connectors 10 are secured in housings 12 and have wire wrap posts 18 extending outwardly therefrom for one or more electrical conductor wires 218 to be wrapped for electrical connection to corresponding one or more terminals of respective one or more electrical systems as desired. Preferably post protectors 224 are secured over the wire wrap arrays, and a cover plate 226 is mounted to the panel for additional protection.

The other ends of cables 206 are electrically connected with shipboard systems 212 or another wire integration panel 202, while the other ends of cables 208 are electrically connected to black boxes 204. The mating plug and receptacle connector assemblies 210,10 must be modular and panel mountable; be uniquely keyed; be easily latchable upon mating in an aligned, keyed and polarized manner; and be easily delatchable. Integration panel 202 can have receptacle connectors 10 mounted thereto and automatically or semi-automatically wired as a total subassembly and tested prior to installation into the aircraft, and also can be removed from the aircraft for testing, repair or replacement if necessary. Panel 202 is hinged at hinge 214 to be lowered forwardly from a supporting structure 216 for easy access to the rearward face of the panel. This access facilitates programming and reprogramming which is essential in order to adapt an aircraft of otherwise standard manufacture to meet the avionic requirements of specific customer airlines.

Figure 3:
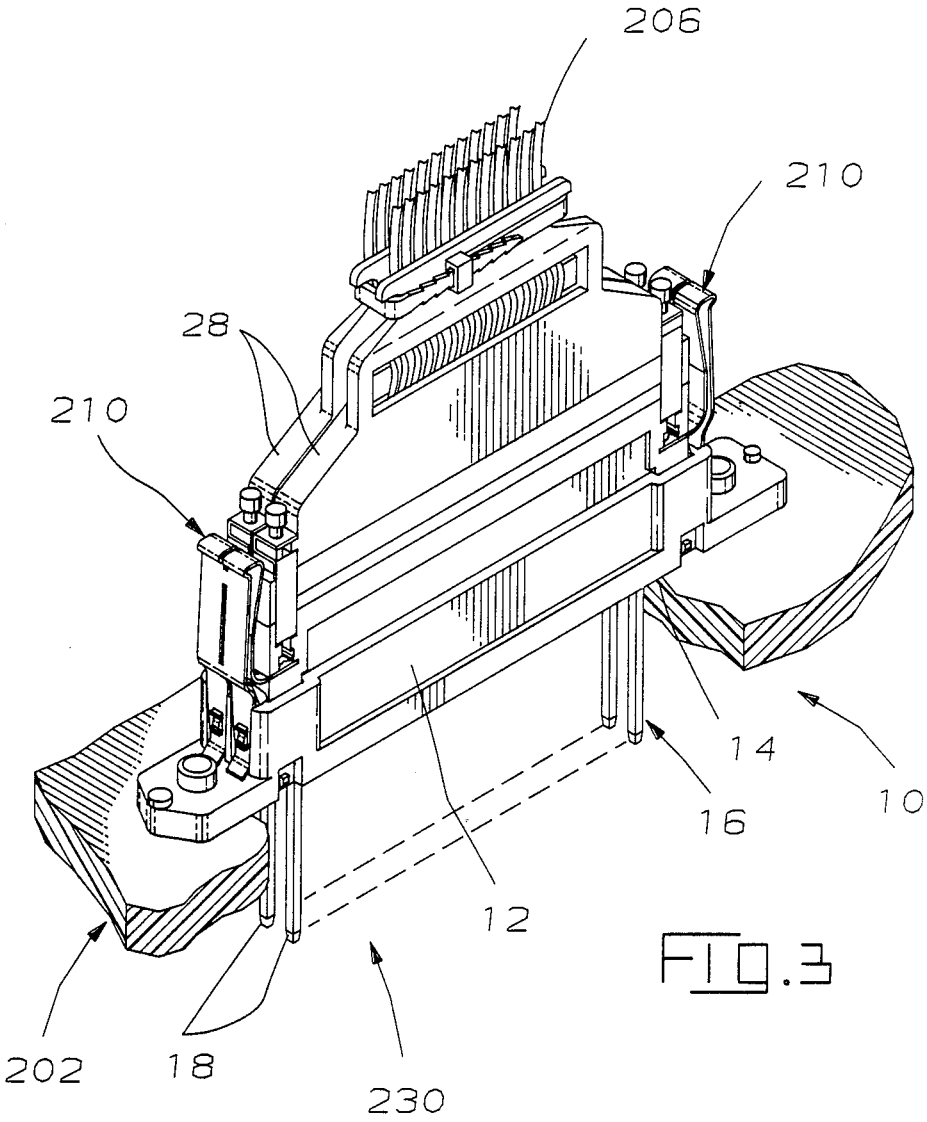
FIG. 3 is a perspective view of mated plug and receptacle connectors for use on a wire integration panel of the system of FIGS. 1 and 2.

FIG. 3 shows a two-row plug connector 210 to mate with the mating face of a two-row receptacle connector 10 mounted to integration panel 202 of FIG. 2, with an array of wire wrap posts 18 of terminals 16 extending from a wire wrap face 14 of the receptacle connector 10. Such a mating connector system 230 for the wire integration system 200 of FIGS. 1 and 2 is described with more particularity in U.S. patent application Ser. Nos. 07/042,205; 07/042,495; 07/042,203; 07/042,084; and 07/042,418 all filed Apr. 24, 1987 and all assigned to the assignee hereof.

Figure 4:
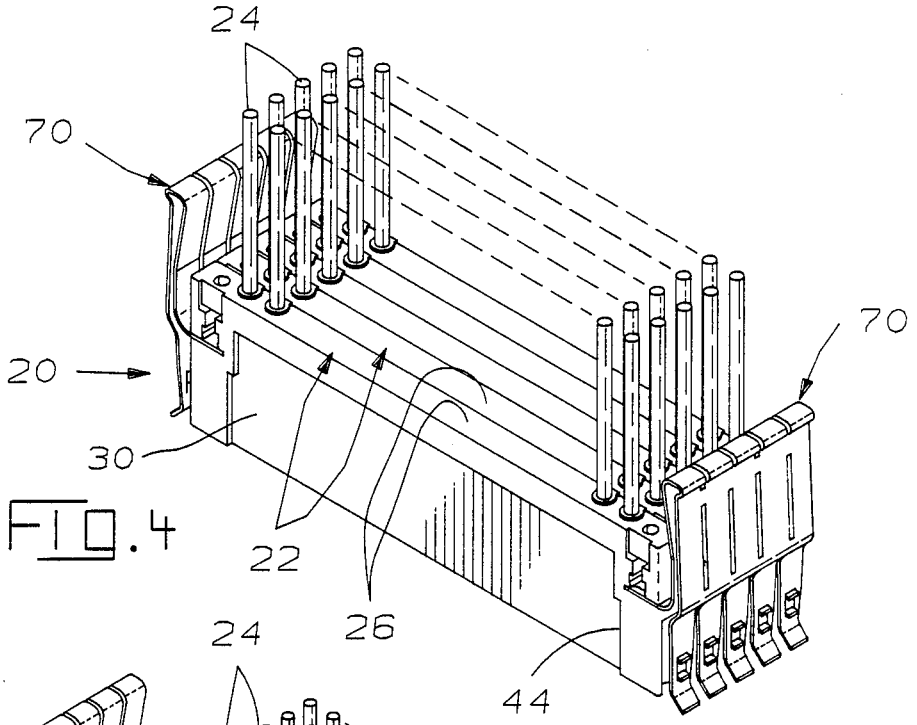
FIG. 4 is a perspective view of an assembly of five plug connector modules ganged together by a pair of spring latch members of the invention.
Figure 5:
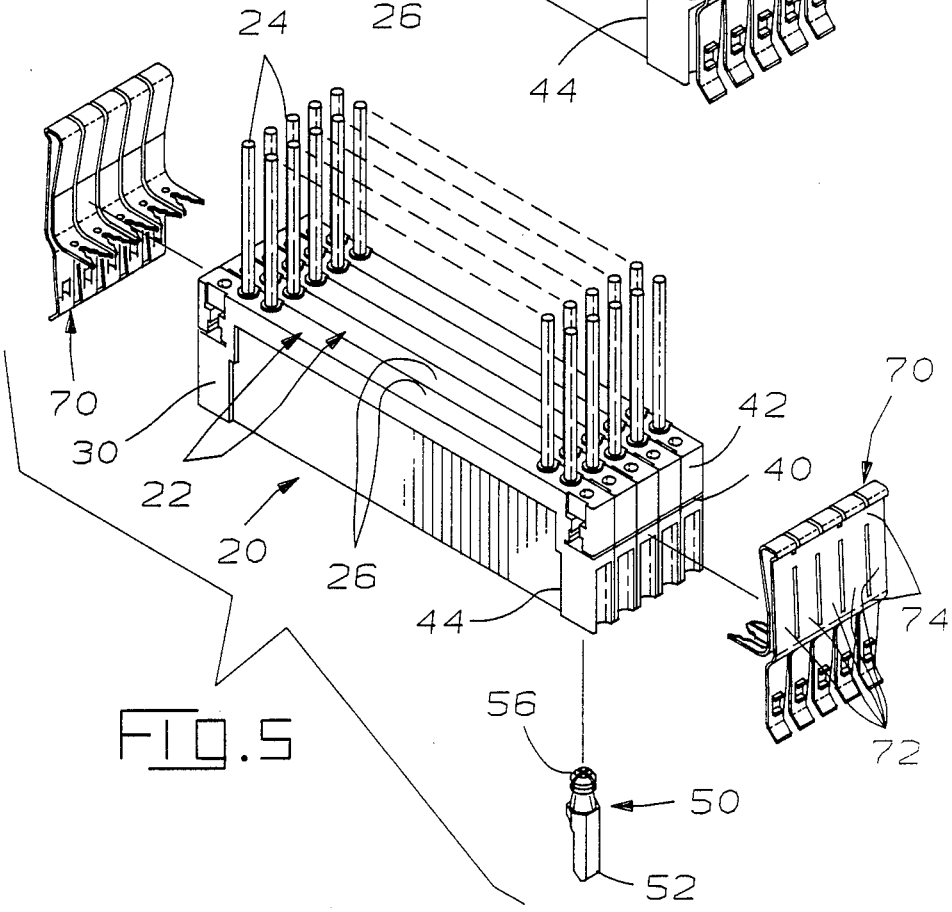
FIG. 5 is similar to FIG. 4 showing the spring latch members exploded from the plug modules, and a representative key member exploded from a passageway of one module, to which the spring latch members may secure.
Figure 8:
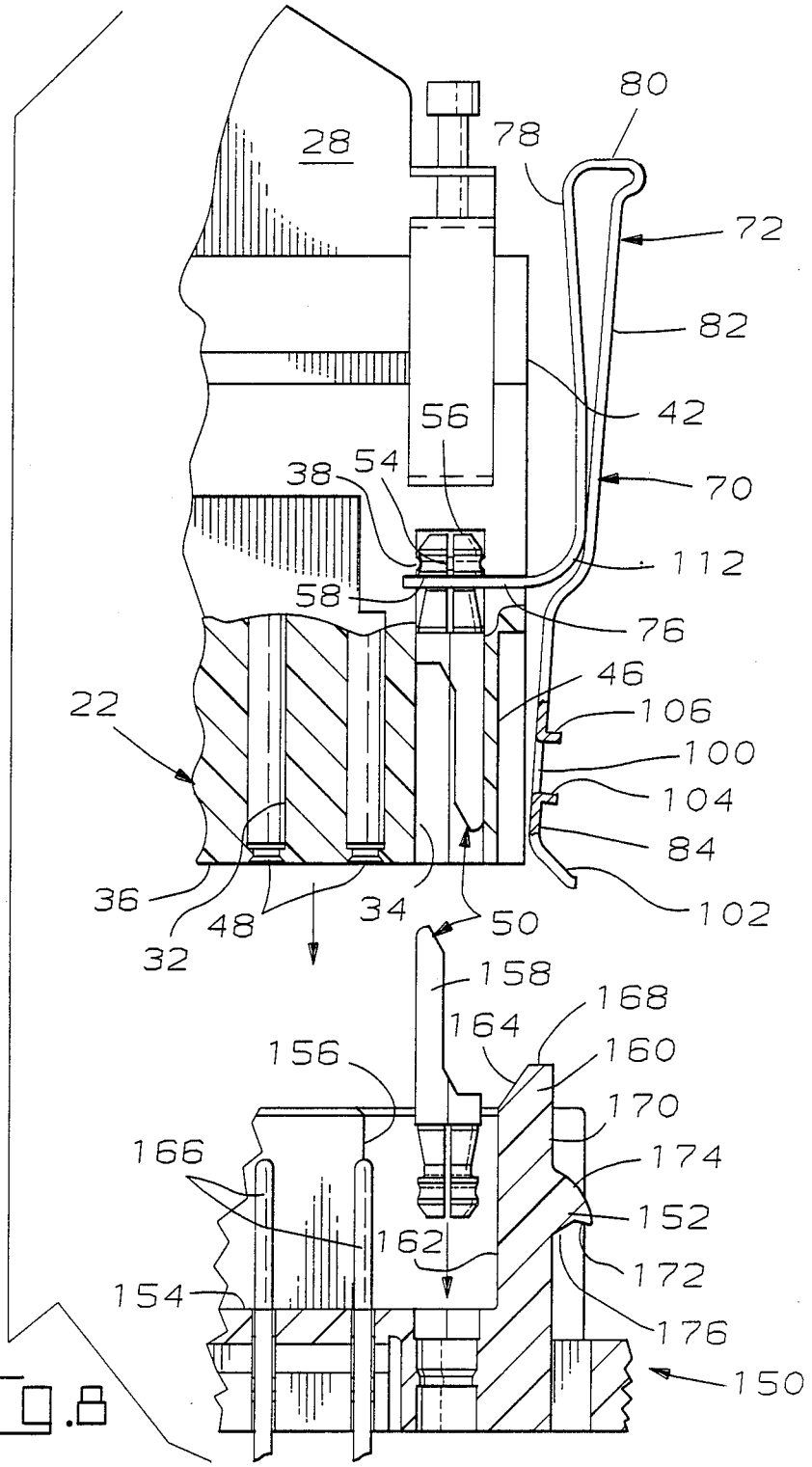
FIGS. 8 and 9 are part section views of one module spaced from and then in mated engagement with a receptacle connector, showing the spring latch member secured to a key member within the module, and latched to the receptacle connector.

Five-row plug connector 20 is shown in FIGS. 4 and 5 to comprise five single-row plug connector modules 22 ganged together in side-by-side relationship, each receiving an array of electrical conductor cables 24 in a cable face 26, with each array of cables 24 firmly engaged by a strain relief 28 (See FIG. 3) of each module 22. Terminals 48 terminated to conductors 24 are secured within module housings 30 within terminal-receiving passageways 32 (FIG. 8). Each module housing 30 includes a key member 50 within a key-receiving passageway 34 at each end 36. Forward key section 52 is shaped in cross-section as just less than one-half of a hexagon and is inserted into hexagonal-shaped key-receiving passageway 34 in an orientation selected to cooperate with the opposite orientation of a mating identical key member 158 extending forwardly from the mating face of the receptacle connector 150 (FIGS. 8 and 9) to which plug connector 20 is to be mated. Each key member 50 is secured within passageway 34 by retention ridges 38 (FIG. 8) extending into first annular recess 54 near rearward key end 56, as is described in more particularity in above-mentioned application Ser. No. 07/042,495. A second annular recess 58 is located near rearward key end 56 where key member 50 intersects and extends past a transverse slot 40 in module housing 30 extending inwardly from end surface 42 just rearwardly of the center of housing 30. Second annular recess 58 comprises a preferred cooperating securing means for securing the spring latch members 70 to the plug connector modules 22 as will be described.

Spring latch members 70 are integrally stamped and formed from strips of spring metal such as stainless steel (preferably of an alloy with low magnetic properties), such as by use of conventional four-action forming apparatus. Each spring latch member 70 is comprised of a plurality of identical segments 72 joined laterally to adjacent segments at preferably pairs of joints 74, and sections of each segment are coplanar with identical sections of the other segments 72 of the spring latch member. Each segment 72 is associated with an end surface 42 of a respective plug connector module 22, and each spring latch member 70 is associated with coextending end surfaces 42 of the plurality of modules 22.

Figure 6:
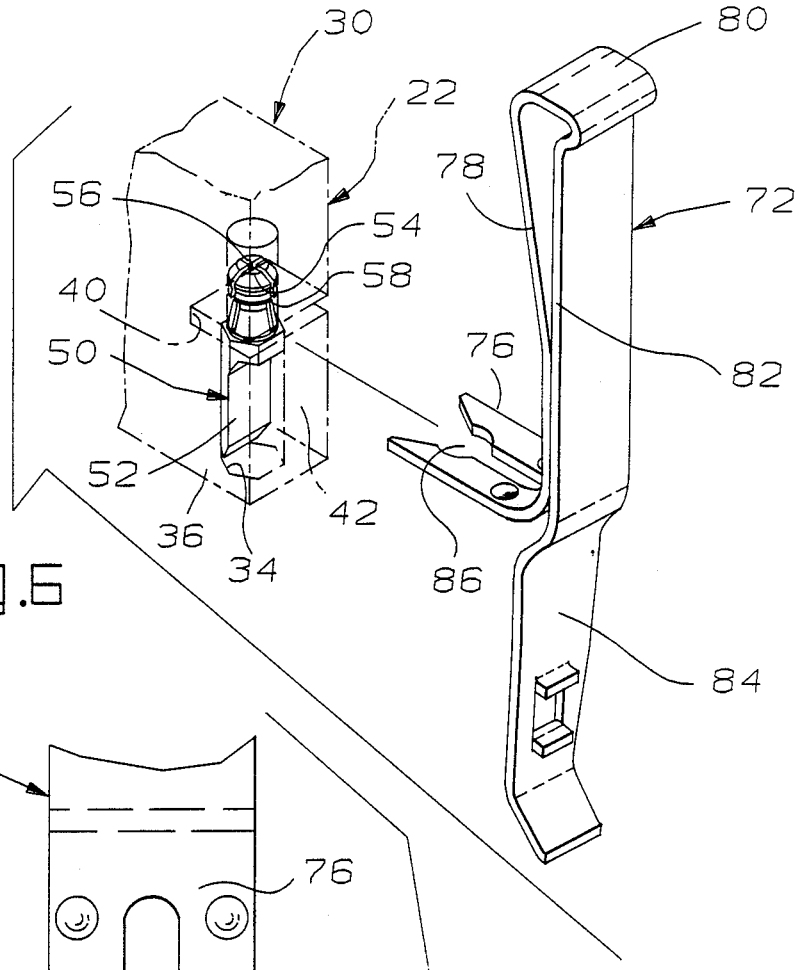
FIG. 6 shows one segment of a spring latch member, and a key member to which it secures, which is contained within a module shown in phantom.

Referring now to FIG. 6, spring latch member segment 72 is shown beside an end surface 42 of a module housing 30 (in phantom) with a key member 50 shown within a passageway 34 of housing 30. Second annular recess 58 is shown intersecting transverse slot 40. Segment 72 comprises a transverse securing section 76, inner body section 78, bight 80, outer body section 82 and forward or first free end 84. Securing section 76 is preferably adapted to secure to an axially extending projection of module 22, preferably key member 50, by receiving the projection into securing recess 86 defined by fingers 88. When spring latch member 70 is urged transversely against end surfaces 42 of modules 22 and securing section 76 enters respective slot 40, fingers 88 extend past both sides of key member 50 within portions of second annular recess 58 so that key member 50 enters securing recess 86. Facing surfaces of fingers 88 define a constriction 90 which causes fingers 88 to be first deflected apart when constriction 90 passes key member 50; fingers 88 then resile to secure around key member 50, securing plug connector module 22 to spring latch member 70. Alternatively key member 50 may be temporarily reduced in diameter until constriction 90 passes by such as the rearward end of key member 50 being comprised of four inwardly deflectable quadrants.

Figure 7:
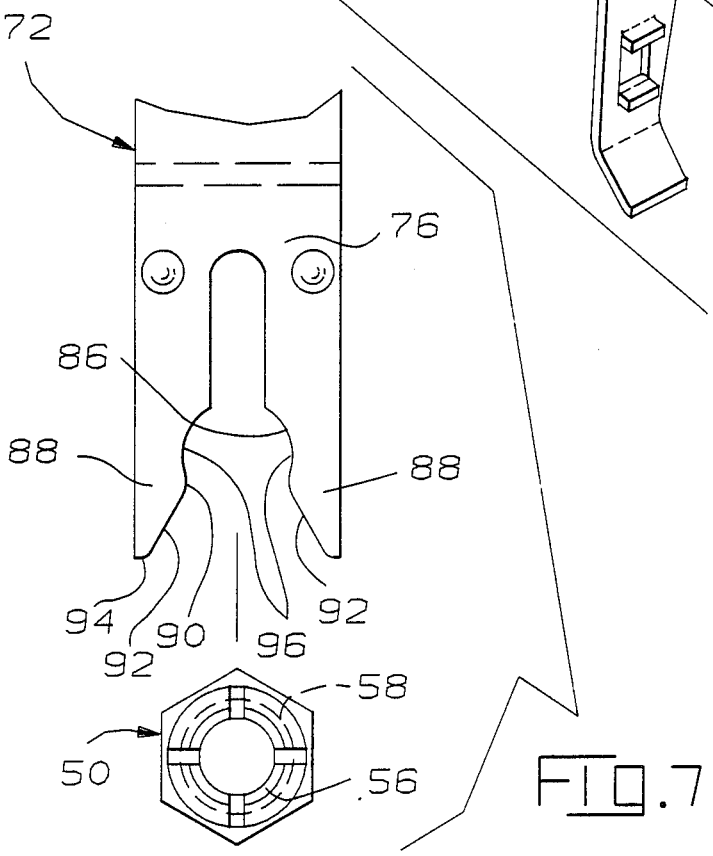
FIG. 7 is a plan view showing the securing section of one segment about to be secured to a key member.

As best seen in FIG. 7, constriction 90 preferably is comprised of first facing surfaces 92 which are angled slightly outwardly toward ends 94 of fingers 88 defining a lead-in, and second facing surfaces 96 which are angled slightly inwardly toward spring latch member 70 defining a lead-out enabling removal of securing section 76 from key member 50 when spring latch member 70 is urged away from modules 22 for removal. Also, preferably, securing recess 86 has a diameter slightly larger than the diameter of second annular recess 58 permitting play to compensate for tolerances so that ganged modules 22 are incrementally movable toward and away from each other during mating with a single mating receptacle connector 150 for individual alignment with respective plug-receiving cavities 154 of the receptacle connector.

Figure 9:
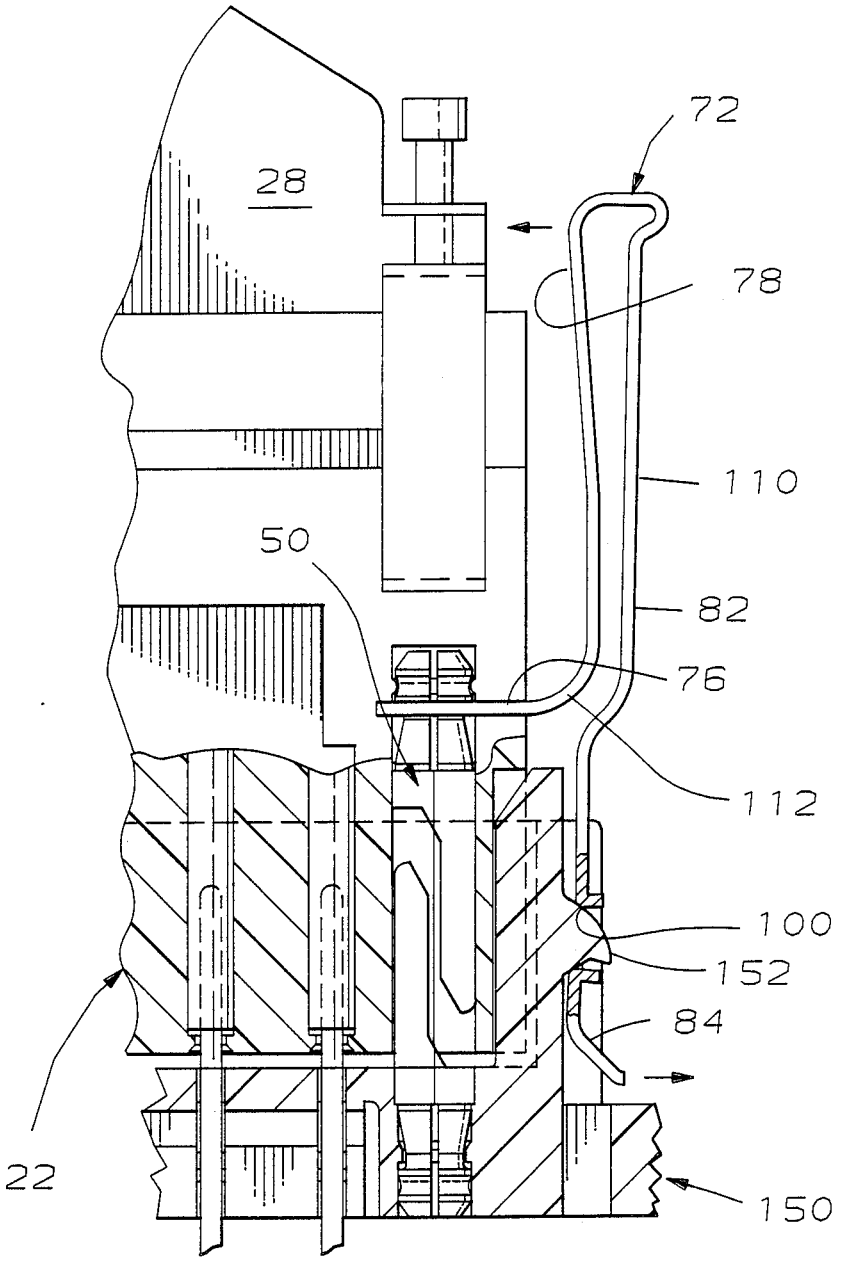

With reference to FIGS. 6, 8 and 9, free end 84 accomplishes the latching of a module 22 with receptacle connector 150. Free end 84 includes preferably a latching recess 100 cooperable with a latching projection 152 of connector 150 to be latchingly engaged by upon full mating. For each module 22, receptacle connector 150 includes a respective plug-receiving cavity 154. The several plug-receiving cavities 154 of receptacle connector 150 are separated from each other and defined by lengths of thin polarizing barrier walls 156, each of which serves to permit only the proper orientation of a respective plug connector module 22 by entering a corresponding long recess 44 along just one of the two major sides of the module, which is shown in FIGS. 4 and 5; one of the two major sides of receptacle connector 150 is appropriately indented to act as a polarizing barrier wall for the end module, as is more particularly described in above-mentioned application Ser. No. 07/042,084. Near both ends of each cavity 154 are cooperating key members 158 for keying purposes. At both ends of cavity 154 are disposed alignment posts 160 having semicylindrical inwardly facing surfaces 162 and a tapered forward post end 164. An alignment post 160 enters a corresponding alignment channel 46 along end surface 42 during initial stages of mating of the connectors, which aligns module 22 both spatially and axially before key members 50,158 engage, only after which contacts 48,166 engage.

Free end 84 concludes in an outwardly angled end section 102. Preferably, free end 84 is disposed close to end surface 42 of a module 22 to be deflected outwardly by receptacle connector 150 during mating. This assures that after latching, free end 84 is stressed slightly to maintain an inwardly directed tension against receptacle connector 150 to assure maintenance of a latched condition of latching projection 152 in latching recess 100. Outwardly angled end section 102 initially engages forward end 168 of alignment post 160 to be deflected outwardly thereby as module 22 is moved toward receptacle connector 150 during mating. Free end 84 moves along and within an outwardly facing channel section 170 of receptacle connector 150 containing latching projection 152. End section 102 then engages latching projection 152 and is deflected farther outwardly thereby to ride over it. Free end 84 then resiles when latching recess 100 aligns beside latching projection 152 and latching engagement occurs. Preferably, latching recess is defined by first and second short tabs 104,106 punched to extend outwardly presenting smooth surfaces to latching projection 152 to prevent damage. First tab 104 preferably extends outwardly at an angle slightly greater than 90° to face rearwardly and outwardly, to cooperate with a latching surface 172 of latching projection 152 which faces inwardly and rearwardly with respect to receptacle connector 150, as shown in FIG. 9. This will prevent inadvertent delatching if axially rearward strain is placed on module 22.

Latching projection 152 is further designed to reduce wear problems from shock and vibration during in-service use of the mated connector assembly, in cooperation with short tabs 104,106. Forward surface 174 of projection 152 is smoothly rounded and convex providing a bearing surface for second short tab 106. Inward from latching surface 172 is an inner surface portion 176 facing rearwardly and slightly outwardly and joining the side surface of receptacle connector 150. Inner surface portion 176 and forward surface 174 adjacent the side surface define a continuous range of axial dimensions which include the axial dimension of latching recess 100 between facing smooth surfaces of first and second short tabs 104,106 adjacent latching projection 152, so that latching projection 152 can fill latching recess 100 in the axial direction at some point. Residual force in spring latch member 70 urges free end 84 inward toward receptacle connector 150 which forces latching recess 100 to fully engage latching projection 152 at forward surface 174 and at inner surface portion 176 continuously during in-service use of the assembly. This full engagement reduces relative motion between plug module 22 and receptacle connector 150 induced by shock and vibration, and instead translates much of the force thus created, laterally outwardly against free end 84 of one or the other of the pair of spring latch members 70 or both which resist the inducing force by their residual, inwardly-directed spring force. This resistance stabilizes plug modules 22 in respective cavities 154 of receptacle connector 150 and minimizes relative slight movement between the contact sections of electrically engaged contacts 48,166 and resultant wear.

A gripping section 110 of each spring latch member segment 72 extends rearwardly beyond structure of module 22 and is comprised of bight section 80 and adjacent portions of outer and inner body sections 82,78. Bend 112 joining inner body section 78 to securing section 76 constitutes a fulcrum, so that if gripping section 110 is deflected inwardly toward end surface 42 of module 22 a pivoting action occurs about bend 112. Free end 84 is thereby urged outwardly from the side of receptacle connector 150 delatching latching recess 100 from latching projection 152, which deflection is enhanced by improved leverage if outer body section 82 engages inner body section 78 near fulcrum or bend 112 after sufficient deflection. Since all segments 72 are integrally joined to each other by joints 74 (FIG. 5) forming integral spring latch member 70, deflection of gripping section 110 of one segment 72 deflects all gripping sections of all segments and deflects the array of free ends 84 of all segments 72 outwardly for simultaneous delatching of all modules 22 from receptacle connector 150. Delatching of the ganged modules 22 is easily accomplished when gripping sections of both spring latch members 70 are urged toward each other, and plug connector assembly 20 can be manipulated as a unit for unmating from receptacle connector 150. Structure at the rearward end of end surface 42 of each module 22 preferably is so placed to be engageable by the corresponding gripping section 110 to prevent overdeflection and overstress of spring latch member 70.

The pair of spring latch members 70 performs two functions simultaneously by ganging together the individual plug connector modules 22 enabling modules 22 to be manipulated as a unitary plug connector assembly 20, and by latching assembly 20 to receptacle connector 150 at a plurality of locations in a manner which enables easy delatching thereof for unmating. Thus, the pair of spring latch members 70 represents a minimized number of parts, which if utilized with key members 50 as disclosed for securing to the modules, further minimizes the total number of parts needed in the plug connector assembly. Members 70 are also disclosed in their preferred embodiment to be easily removable from modules 22 to enable repair, such as replacement of a conductor cable 24 or the contact 46 terminated thereto.

Members 70 also are formed with securing sections 76 at fixed spaced locations, corresponding to the spacing of plug-receiving cavities 154 of receptacle connector 150; modules 22 have designed dimensions between their major side surfaces incrementally slightly smaller so that they may be ganged together with incremental spacing therebetween, all of which compensates for manufacturing tolerances when assembled to spring latch members 70.

Modifications may be made to the spring latch members of the present invention, such as the shape of the gripping sections, or to the manner of securing to the modules, or to the manner of latching, which are within the spirit of the invention and the scope of the claims.

We claim:

1. A spring latch for securing at least one first connector module to a mating connector in mated engagement in cooperation with another like spring latch, comprising:

an integral member stamped and formed from spring metal having $\eta$ segments to be disposed along an end of a corresponding $\eta$ connector modules, each of said segments integrally joined laterally to adjacent said segments, each of said $\eta$ segments comprising:

a first free end including a latching means latchable with a cooperating latching means of a mating connector for latchably securing a said respective module to said mating connector when said module and said mating connector are mated;

an outer body section extending substantially axially rearwardly from said first free end to a bight;

an inner body section extending forwardly from said bight substantially along an inwardly facing surface of said outer body section to a fulcrum section at a location spaced rearwardly from said latching means of said first free end; and a second free end extending substantially transversely inwardly from said fulcrum section and including a securing means adapted to securely attach to a cooperating securing means of said module securing said integral member along a said end of said module spacing said inner body section from said end of said module, whereby said first free end is deflectable outwardly at least during latching of said module with said mating connector during mating and resiles when said latching means latchably engages with said cooperating latching means to latch said module to said mating connector; and said outer body section, said bight, and said inner body section comprise a gripping section deflectable toward said end of said module about said fulcrum section and urging said first free end correspondingly outwardly thereby disengaging said latching means from said cooperating latching means delatching said module from said mating connector thereat.

2. A spring latch as set forth in claim 1, wherein $\eta$ is greater than one and at least a second said segment is joined to a first said segment at least at a first joint between adjacent facing side edges of respective said outer body sections thereof proximate respective said bights thereof, respective said second free ends adapted to be secured to ends of respective ones of said $\eta$ modules and ganging together said modules in side-by-side relationship, and respective said gripping sections thereof being deflectable inwardly simultaneously, whereby said ganged modules are latchable and delatchable from said mating connector as a unit.

3. A spring latch as set forth in claim 1 wherein said first free end of each segment includes a latching recess adapted to latchably engage a latching projection extending outwardly from a side of said mating connector, and said first free end concludes in an outwardly angled section adapted to ride over said latching projection when said first free end is moved axially forwardly along said side of said mating connector during mating of said modules and said mating connector, and to deflect laterally outwardly said first free end until said latching recess is adjacent said latching projection and said first free end resiles and latching engagement occurs.

4. A spring latch as set forth in claim 3 wherein said latching recess includes rearwardly facing and forwardly facing surfaces defined respectively by surface portions of first and second short tab sections extending outwardly from said first free end a selected distance apart.

5. A spring latch as set forth in claim 4 wherein said first tab section is formed to extend outwardly at an angle slightly greater than 90°, whereby said rearwardly facing surface defined thereby faces slightly outwardly to cooperate with a forwardly facing surface of said latching projection facing slightly inwardly in a stopping engagement to prevent inadvertent disengagement of said first free end from said mating connector upon incidental axially rearward tension.

6. A spring latch as set forth in claim 1 wherein said second free end concludes in opposing fingers defining a recess therebetween to receive an axially extending said cooperating securing means thereinto, and ends of said fingers converge slightly defining a constriction, whereby said fingers extend partially around said cooperating securing means at said constriction and secure said integral member to said end of said module.

7. A spring latch as set forth in claim 6 wherein said second free end and said fingers thereof are disposed in a plane transverse to said module and said fingers are adapted to be deflectable outwardly from each other, and include lead-in means to receive said cooperating securing means into said recess from a position inwardly from said second free end, whereby said second free end receives thereinto and securely engages around said cooperating securing means when said integral member is urged inwardly toward said end of said module with said second free end axially located at said cooperating securing means.

8. A spring latch as set forth in claim 7 wherein said recess proximate said constriction comprises surfaces angled toward each other and toward said inner body section permitting said cooperating securing means to deflect said fingers apart during outward urging of said integral member from said respective end surface for removal of said integral member from said module.

9. An assembly of connector modules ganged together in side-by-side relationship to matingly engage a mating connector, said assembly comprising:

a plurality of like connector modules each having opposed side surfaces and opposed end surfaces extending from a mating face to a cable face, said side surfaces of each said module adapted to be disposed adjacent to side surfaces of adjacent ones of said modules with said end surfaces of said modules being essentially disposed in common outwardly facing planes; and a pair of opposed spring latch members each disposed along a respective said common plane of said module end surfaces, and each comprising a like plurality of integrally joined segments corresponding to respective said module end surfaces, wherein each said segment comprises:

a first free end including a latching means latchable with a cooperating latching means of a mating connector upon mating engagement of said modules with said mating connector;

an outer body section extending substantially axially rearwardly from said first free end to a bight;

an inner body section extending forwardly from said bight substantially along an inwardly facing surface of said outer body section to a fulcrum section at a location spaced rearwardly from said latching means of said first free end; and a second free end extending substantially transversely inwardly from said fulcrum section and including a securing means adapted to securely attach to a cooperating securing means along a said end surface of a respective said module to secure said module thereat to said spring latch segment, whereby said modules are each secured at respective said end surfaces to respective segments of said opposed spring latch members and are thereby ganged together in side-by-side relationship, and said opposed spring latch members define opposing arrays of first free ends disposed forwardly of said second free ends and spaced outwardly from said module end surfaces, said latching means of said opposing arrays of first free ends being simultaneously latchable to cooperating latching means on opposed ends of a said mating connector during mating of said ganged modules therewith.

10. An assembly as set forth in claim 9 wherein each said outer body section, said bight, and said inner body section of each said spring latch segment comprise a gripping section spaced outwardly from and deflectable toward an end surface of a respective said module about said fulcrum section joining said second free end thereof to said inner body section thereof, whereby inward deflection of a said gripping section of one or more said segments of each of said opposed spring latch members results in inward deflection of all said gripping sections and outward deflection of said first free ends of all said segments enabling simultaneous delatching of said ganged modules for unmating thereof from said mating connector.

11. An assembly as set forth in claim 10 wherein said gripping sections extend rearwardly from said modules to facilitate gripping thereof.

12. An assembly as set forth in claim 11 wherein each said module includes structure at the rearward end of said end surfaces spaced a selected distance inwardly from an inside surface of said inner body section to be engageable by a respective said gripping section to prevent overdeflection and overstress thereof during delatching.

13. An assembly as set forth in claim 9 wherein each said second free end of a said segment is received into a slot extending transversely inward from a said end surface of a respective said module to securely engage a said cooperating securing means thereof.

14. An assembly as set forth in claim 13 wherein said securing means of each said second free end comprises a pair of fingers spaced apart defining a recess therebetween to receive an axially extending said cooperating securing means thereinto during movement of said second free end into a respective said slot relatively toward said module end surface, and said fingers defining a constriction along said recess comprising a first pair of facing surfaces angled slightly away from said spring latch member constituting lead-ins, facilitating securing of said securing means and said cooperating securing means, and a second pair of facing surfaces angled slightly toward said spring latch member constituting lead-outs facilitating removal of said securing means from said cooperating securing means for disassembly of said module from said spring latch member when said spring latch member is urged relatively away from said module end surface.

15. An assembly as set forth in claim 14 wherein an insert member is disposed along an axially extending cavity proximate said end surface of said module and including a substantially cylindrical section intersecting said slot comprising said cooperating securing means.

16. An assembly as set forth in claim 9 wherein each said module includes a channel section extending along each said end surface thereof from said mating face opposed and spaced from a respective said first free end of a said spring latch member segment, said mating connector includes alignment post portions in opposing pairs extending from said mating face thereof associated with said channel sections and adapted to enter therealong during mating for aligning said module with said mating connector, and said mating connector includes an outwardly facing channel section outward from each said alignment post portion and adapted to receive thereinto and therealong a respective said first free end of a said spring latch member segment, each said outwardly facing channel section including a respective latching projection latchable with a latching recess of a said first free end upon full mating of said module and said mating connector.

17. An assembly as set forth in claim 16 wherein said outwardly facing channel sections and said first free ends of said spring latch members secured to said ganged modules are constructed and spaced such that said first free ends are deflected slightly outwardly by said mating connector during mating resulting in said opposing spring latch members maintaining a spring force against said opposing sides of said mating connector after latching.

18. An assembly as set forth in claim 9 wherein said modules are plug connector modules and said mating connector is a receptacle connector.

19. A latching system for latching a first article and a second article when the articles are urged together along an axis to a fully mated relationship, the second article having a latching projection extending from a selected side surface thereof and the first article having a spring latch means including a free end extending forwardly with a latching recess therein associated with the latching projection, characterized in that;

said latching recess has a selected axial dimension defined between forward and rearward tab sections extending transversely outwardly relative to said side surface of said second article, said tab sections having smooth facing surfaces spaced apart a selected distance proximate said latching projection, and said forward tab section extending outwardly at an angle greater than 90° such that its rearwardly facing surface faces slightly outwardly;

said latching projection comprises a convex smooth surface facing said first article and associated with said rearward tab section and a rearwardly facing surface associated with said forward tab section and having a latching surface portion spaced from said side surface of said second article facing slightly inwardly toward said side surface cooperable with said forward tab section to resist relative outward movement of said tab section, and further having an inner surface portion adjacent said side surface angled to face slightly outwardly, and said latching projection having a continuous range of axial dimensions defined between said inner surface portion and said convex surface adjacent said side surface which includes said selected said side axial dimension of said latching recess; and said spring latch means being adapted such that said free end retains a residual force against said side surface of said second article after latching engagement of said first and second articles, whereby said facing smooth surfaces of said latching recess are in continuous engagement with said latching projection surfaces after latching to resist inadvertent delatching and to resist degrading effects of shock and vibration affecting said first and second articles.

* * * * *